US005846333A

United States Patent [19]

Partida et al.

[11] Patent Number: 5,846,333

[45] Date of Patent: Dec. 8, 1998

[54] METHOD OF PRODUCING FRUCTOSE SYRUP FROM AGAVE PLANTS

[76] Inventors: Virgilio Zuniga Partida, Oscar wilde 6089, 45020 Zapopan, Jalisco, Mexico; Arturo Camacho Lopez, Josefa Ortiz de Dominguez 532; Alvaro de Jesus Martinez Gomez, Basilio Badillo 429, both of 44380 Guardalajara Jalisco, Mexico

[21] Appl. No.: 614,349

[22] Filed: Mar. 12, 1996

[51] Int. Cl.[6] ..... C13K 11/00

[52] U.S. Cl. ..... 127/37; 127/42; 127/43; 127/46.2; 127/48; 127/55

[58] Field of Search ..... 127/37, 42, 43, 127/46.2, 48, 55

[56] References Cited

U.S. PATENT DOCUMENTS

| | | | |
|---|---|---|---|
| 2,461,163 | 2/1949 | La Lande . | |
| 2,594,440 | 4/1952 | Hughes . | |
| 2,834,694 | 5/1958 | Hill . | |
| 3,558,355 | 1/1971 | Okazaki . | |
| 3,806,363 | 4/1974 | Takasaki . | |
| 4,138,272 | 2/1979 | Zapeda-Castillo | 127/37 |
| 4,277,563 | 7/1981 | Kerkhoffs | 435/99 |
| 4,285,735 | 8/1981 | Mitchell . | |
| 4,326,037 | 4/1982 | Griffith . | |
| 4,332,622 | 6/1982 | Hohnerlein . | |
| 4,421,852 | 12/1983 | Hoehn et al. | 435/99 |
| 4,471,114 | 9/1984 | Sherman . | |
| 4,861,381 | 8/1989 | Paul . | |
| 4,871,397 | 10/1989 | Stevens . | |
| 4,950,332 | 8/1990 | Stringfield . | |
| 5,094,694 | 3/1992 | LaBrie . | |
| 5,127,956 | 7/1992 | Hansen . | |
| 5,230,742 | 7/1993 | Lillard . | |
| 5,254,174 | 10/1993 | Hansen et al. | 127/53 |
| 5,350,456 | 9/1994 | Schwab . | |

FOREIGN PATENT DOCUMENTS 2097796 10/1982 United Kingdom .

OTHER PUBLICATIONS

Zuniga, P.V., Mendez, C.M., Cham, L.G., Hernandez, R. L., and Paggy, T. Hidrolisis de Polifructosanas de Extractos de Agave Azul usando Levaduras no Viables Inmovilizadas. Avances en Ingenieria Quimica, 1988, pp. 45–53. See translation of this article entitled "Hydrolysis of Polyfructosans of Blue Agave Extracts using Immobilized Non–Viable Yeasts.".

Mitsubishi Kasei Corporation, *Diaion® RA–308—Porous Type I Second Generation—Highly Basic Anion Exchange Resin*, Rev. #1, Jul., 1989.

*Dianon® SK1B and SK110—Gel Type—Strong Acid Cation Exchange Resin—Hydrogen Cycle—Hydrochloric Acid Regeneration*, Dianex Sytems, Lockport, NY (at least as early as Jan. 5, 1996).

*Fructozyme™*, ©Nova Nordick, Oct. 1993, Bioindustrial Group, Novo Nordisk AVS, Denmark.

*Primary Examiner*—David W. Wu

*Attorney, Agent, or Firm*—Davis, Graham & Stubbs LLP

[57] ABSTRACT

A pulp of milled agave plant heads are liquified during centrifugation and a polyfructose solution is removed and then concentrated to produce a polyfructose concentrate. Small particulates are removed by centrifugation and/or filtration and colloids are removed using termic coagulation techniques to produce a partially purified polyfructose extract substantially free of suspended solids. The polyfructose extract is treated with activated charcoal and cationic and anionic resins to produce a demineralized, partially hydrolyzed polyfructose extract. This partially hydrolyzed polyfructose extract is then hydrolyzed with inulin enzymes to produce a hydrolyzed fructose extract. Concentration of the fructose extract yields a fructose syrup.

16 Claims, No Drawings

METHOD OF PRODUCING FRUCTOSE SYRUP FROM AGAVE PLANTS

BACKGROUND OF THE INVENTION

1. Field of the Invention

This invention relates to the field of fructose extraction processes, and more particularly to extraction processes for producing fructose syrup from agave plants.

2. Description of the Prior Art

Polyfructose, which may be obtained from agave plants, is processed into fructose syrup for use in foods and beverages. The conventional techniques for producing fructose syrup from agave plants produce syrups of differing quality, depending on the particular technique. Generally speaking, high quality fructose syrup is clear in color and substantially free of the taste and aroma of the agave plant. A poor quality fructose syrup has a yellow-brownish color and is tainted by the taste and smell of the agave plant.

The termic process is a well known fructose syrup production technique used to produce fructose syrup for the tequila industry, where color, taste and aroma of fructose syrup may not be critical. The termic process is based upon the coagulation of colloids in an agave plant extract to produce coagulated aggregates, which may be accomplished by the addition of diatomaceous earth. The coagulated aggregates are separated for removal by centrifugation or filtration. While the capital investment necessary to run a termic process is low and the processing time is acceptable, the resulting fructose syrup has a low purity. Such syrup is typically yellow or brownish, and often includes contaminants, such as hydroxymethylfurfural, which may be toxic.

Another conventional process for producing fructose syrup from agave plants is known as the acid hydrolysis process. This process typically involves the use of a mineral acid such as sulfuric or hydrofluoric acid. While the capital investment necessary to run an acid hydrolysis process is low and the processing time is favorable, the resulting fructose syrup is generally of a medium purity and having a yellowish or brownish tint. Such syrup may also contain contaminants such as hydroxymethylfurfural.

A third process for producing fructose syrup from plants is an enzymatic process, such as that described in U.S. Pat. No. 4,277,563 for PREPARATION OF FRUCTOSE to Kerkhoffs, which issued Jul. 7, 1981. This patent teaches a method of recovery of fructose by treatment of minced plant parts in an aqueous medium with inulase enzyme for 24–29 hours, with stirring. A solution is separated with centrifugation, treated with activated carbon, filtered, passed through a strongly acid ion exchanger, then over a weakly basic ion exchanger, and evaporated, and the resulting solid substance treated to produce fructose crystals. This enzymatic process results in high purity fructose syrup having desirable taste, smell and color. However, the processing time is lengthy, and the process involves the use of organic solvents, which may not be preferred under certain circumstances.

Another enzymatic process is taught in U.S. Pat. No. 4,421,852 for PRODUCTION OF HIGH FRUCTOSE SYRUP FROM INULIN INVOLVING ULTRAFILTRATION to Hoehn, et al, which issued Dec. 20, 1983. The method disclosed includes the ultrafiltration of solutions using membrane techniques to separate solubilized amino acids, peptides and minerals from inulin containing solutions. After enzymatic hydrolysis, ultrafiltration using membrane techniques is again employed, this time to separate fructose containing solution from other molecules. Although enzyme treatment time is reduced with this method, ultrafiltration equipment may require heightened capital expenditures, ongoing membrane costs, and decreased production efficiency.

Thus, there remains a need in the art for a method of extracting fructose syrup from polyfructose obtained from agave plants, which produces a high purity fructose syrup with desirable color, smell and taste after a favorable processing time. Preferably, such a method would require a substantially lower capital expenditure than the enzyme processes currently used.

It is against this background that the significant improvements and advancement of the present invention have taken place in the field of fructose syrup extraction processes.

SUMMARY OF THE INVENTION

It is an object of the present invention to produce a high fructose content syrup through the processing of milled agave plant pulp. It is another object of the present invention to produce a high fructose content syrup in the aroma and flavor of the agave plant are removed without undue expense. It is another object of the present invention to produce a concentrated fructose syrup which is stable over time and suitable for human consumption in a wide variety of food and beverages. It is yet another object of the present invention to produce a high fructose content syrup in which the color and flavor may be varied by selection of the combination of processing steps and by variation in the length of individual processing steps.

The preferred method of the present invention processes milled agave plant heads to produce a concentrated fructose syrup. Agave pulp is prepared using standard chopping and pulverizing techniques, is first liquified during centrifugation and a polyfructose solution is removed. The polyfructose solution is then concentrated to produce a polyfructose concentrate. Small particulates are removed by centrifugation and/or filtration to produce a polyfructose concentrate substantially free of suspended solids. Colloids are removed from this polyfructose concentrate to produce a partially purified polyfructose extract. The partially purified polyfructose extract treated with activated charcoal to produce a further purified polyfructose extract. This polyfructose extract is then treated with cationic and anionic resins to produce a demineralized, partially hydrolyzed polyfructose extract. This partially hydrolyzed polyfructose extract is then hydrolyzed with inulin enzymes to produce a hydrolyzed fructose extract. Concentration of the fructose extract yields a fructose syrup.

The fructose syrup produced with the method of the present invention has relatively high fructose content. The aroma and flavor of the agave plant are removed without undue expense, and, alternatively, may be controlled by varying the processing period for some of the purification steps. The concentrated fructose syrup is stable over time and may be used for human consumption in a wide variety of food and beverages.

A more complete appreciation of the present invention and its scope can be obtained from understanding the accompanying drawings, which are briefly summarized below, the following detailed description of the presently preferred embodiment of the invention, and the appended claims.

DETAILED DESCRIPTION OF THE INVENTION

The preferred method of the present invention processes milled agave plant heads to produce a concentrated fructose syrup. As is described in more detail below, an agave pulp is prepared from chopped and pulverized agave plant heads. The pulp is liquified during centrifugation and a polyfructose solution is removed, for subsequent concentration to produce a polyfructose concentrate. Small particulates are removed by centrifugation and/or filtration to produce a polyfructose concentrate substantially free of suspended solids. Colloids are removed from this polyfructose concentrate to produce a partially purified polyfructose extract. The partially purified polyfructose extract is treated with activated charcoal to produce a further purified polyfructose extract. This polyfructose extract is then treated with cationic and anionic resins to produce a demineralized, partially hydrolyzed polyfructose extract. This partially hydrolyzed polyfructose extract is then hydrolyzed with inulin enzymes to produce a hydrolyzed fructose extract. Concentration of the fructose extract yields a fructose syrup.

More particularly, and using conventional means known in the art, agave plant heads are milled by first chopping them into lengths of from approximately 5 to 10 centimeters, i.e., approximately 2 to 4 inches. The lengths are then pulverized between fiber-removing disks to produce a pulp. A preferred fiber-removing disk is available from Mca SPROUT WALDROMN. The pulverizing steps are preferably performed in multiple stages, preferably four or five stages to optimize subsequent extraction.

Approximately 800–1000 liters of water at from 60° to 90° C. is added to each metric ton of agave plant pulp, mixed therewith and then centrifuged to produce a liquified pulp and an aqueous polyfructose supernatant solution. The polyfructose solution is separated from the liquified pulp and the pulp discarded. The polyfructose solution has a preferred concentration of approximately 15°–19° Brix, with residual carbohydrates of at most approximately 3% by weight in the discarded pulp.

The polyfructose solution then concentrated using conventional techniques in a vacuum evaporator at between 40° C. and 70° C., until total solids of the polyfructose extract are from approximately 300 to 500 grams per liter (g/l), preferably 350 to 400 g/l. These solids typically contain undesirable suspended solids, for example, dirt and plant material.

The undesirable suspended solids are removed from the polyfructose concentrate by centrifugation and/or filtration to produce a polyfructose concentrate substantially free of suspended solids. The preferred filtration method is press filtration utilizing a canvas or paper filter having a 1 to 20 micron nominal pore dimension, most preferably a 5 to 10 micron nominal pore dimension. Filtration of the more finely suspended solids is improved by adding diatomaceous earth, for example, 4.2 kg of grade 447 Dicalite™ available from Tlanepantla, state of Mexico, Mexico, for each metric ton of agave pulp processed into the polyfructose concentrate prior to centrifugation or filtration.

The polyfructose concentrate substantially free of suspended solids contains colloids, primarily proteins, waxes, tannins, gums, rubbers and pectin, which are removed utilizing termic coagulation techniques. More particularly, the extract is shaken while heating to approximately 50°to 90° C., and most preferably 70°to 80° C., for approximately 40 minutes, during which time colloids coagulate. Preferably, diatomaceous earth is added to the polyfructose concentrate, in a preferred weight ratio of 1.8 kilograms of diatomaceous earth per metric ton of agave pulp, prior to the heating and mixing step, to facilitate aggregation and formation of coagulants. The coagulants are removed by either centrifugation or filtration to product a partially purified polyfructose extract.

The partially purified polyfructose extract is then treated with activated charcoal. Undesirable organic contaminants from the agave plants which are responsible for characteristic agave plant aroma and taste are adsorbed by the activated charcoal. Preferably, activated charcoal powder, for example Clarimex DB available from Clarimex Tlanepantla of Mexico, Mexico, is added to the extract in a weight ratio of 10 gr:1080 gr Clarimex DB to polyfructose extract. The extract and activated charcoal are heated and agitated to produce a slurry of from 40°to 90° C., preferably from 70°to 80° C., and most preferably 80° C. The heated slurry is preferably agitated for approximately 30 to 120 minutes, most preferably 60 minutes, and then filtered through a press filter containing filter media with pores of four micron nominal dimension. The filtration step separates the activated charcoal and adsorbed contaminants from the extract to produce a further purified polyfructose extract. When the slurry is agitated at 80° C. for at least 60 minutes, the further purified polyfructose extract is clear and substantially free of undesirable aroma or taste.

The further purified polyfructose extract is treated with cationic resins, for example Diaion® SK 1B or SK 110, bead-form, strong acid, gel-type cation exchange resins based on crosslinked polystyrene with sulfonic acid function groups, available from Dianex Systems of Lockport, N.Y., to produce an acidified, demineralized polyfructose extract. During the process, cations in the extract are exchanged for protons, preferably producing an extract of pH from 1.8 to 2.3, with a pH of approximately 2.1 most preferable. The cationic exchange is preferably conducted at approximately 85° C. for 8 to 10 minutes, thereby partially hydrolyzing polyfructose in the acidified, demineralized polyfructose extract.

The acidified, demineralized polyfructose extract is then subjected to an anionic resin such as Mitsubishi Kasei Corporation's Diaion® PA-308, a bead-form, highly basic anion exchange resin having a structure based on crosslinked polystyrene with quaternary ammonium functional groups, also available from dianex Systems of Lockport, N.Y. The extract product produced thereby is then further subjected to the Diaion SK 1B or other cationic resin, thereby produced a partially hydrolyzed and demineralized polyfructose extract in which the molecular weight of the polyfructose and other carbohydrates in the extract are substantially reduced.

The partially hydrolyzed and demineralized polyfructose extract is then hydrolyzed by treatment with an inulin enzyme, preferably (1–2) fructan-fructano-hydrolase, most preferably inulin enzyme available in a complex, for example Fructozyme™ available from Nova Nordisk, Bioindistrial Group, Novo Alle', 2880 Bagsvaerd, Denmark, to produce a substantially hydrolyzed fructose extract, it being understood that this hydrolyzed fructose extract may also contain some glucose, but that larger molecular weight sugars will have been hydrolyzed. Fructozyme™ is a mixture of exo-inulinase and endoinulinase obtained from *Aspergillus niger,* having a standard strength of 2000 INU/gram. Preferably, 2880 INU are added per liter of fructose extract. The mixture is mixed and heated to from 30°to 60° C., with pH of from approximately 3.0 to 7.0, for 2 to 8 hours. More preferably, the temperature is mixed from 4 to 5 hours at from 40° to 50° C. and pH is maintained at from 4.0 and 5.0, for between four and five hours. Most preferably, the resulting mixture has a pH 4.5 and is treated at 50° C. for 6 hours.

The hydrolyzed fructose extract is then concentrated using conventional techniques in a vacuum evaporator and filtered through a membrane having a 0.45 micron nominal pore size, to produce a fructose concentrate of from 60°to 85° Brix, preferably 77.50° Brix.

EXAMPLE I

Agave plant heads are milled and pulverized as describe above to produce a pulp. The pulp is placed in a centrifuge and water heated to 90° C. is added to the pulp in a ratio of 860 liters of water to each metric ton of agave plant pulp to produce, after centrifugation, a polyfructose solution fraction having a concentration of 19° Brix. The polyfructose solution is filtered through a screen filter to remove most of the suspended particulates. The more fine suspended material is eliminated by mixing diatomaceous earth with the polyfructose solution in a weight ratio of 4.2 kg. of diatomaceous earth to each metric ton of agave pulp, and then filtering the solution through a press filter having a four micron nominal dimension, to produce the polyfructose solution substantially free of suspended solids. This solution is then heated to 80° C. for 40 minutes, after which the coagulants are removed by filtration through a press filter having a four micron nominal dimension, to produce a partially purified polyfructose solution. The partially purified polyfructose solution is mixed with activated charcoal to form a slurry and agitated at 80° C. for 1 hour. The activated charcoal is removed by filtration of the slurry through a press filter having 4 micron nominally dimensioned pores, to produce a further purified polyfructose extract in which undesirable color, taste, smell and saponin has been removed. The further purified polyfructose extract is passed through an ion exchange column containing Diaion SK 1B and SK 110 cationic resin. After passing the column, the extract reaches a pH of 2.1, and is then heated to 85° C. during a 10 minute period. The resulting acidified and demineralized polyfructose extract is then passed through an ion exchange column containing an Diaion PA 308 anionic resin, followed by another pass through the ion exchange column containing cationic resins just described, to produce a demineralized and partially hydrolyzed polyfructose extract. Hydrolysis of this polyfructose extract is achieved by addition of 2880 INU per liter of partially hydrolyzed polyfructose extract and agitating at 50° C. for 6 hours at a pH of 4.9, producing a fully hydrolyzed fructose extract thereby. The fructose extract is filtered through a membrane having 0.45 micron nominally dimensioned pores, and concentrated under vacuum evaporation to a concentration of 77.5° Brix, to produce a translucent fructose syrup having a pleasant flavor.

EXAMPLE II

Agave plant heads are milled and pulverized as describe above to produce a pulp. The pulp is placed in a centrifuge and water heated to 90° C. is added to the pulp in a ratio of 860 liters of water to each metric ton of pulp to produce, after centrifugation, a polyfructose solution fraction having a concentration of 19° Brix. The polyfructose solution is filtered through a screen filter to remove most of the suspended particulates. The more fine suspended material is eliminated by mixing diatomaceous earth with the polyfructose solution in a weight ratio of 4.2 kg. of diatomaceous earth to 1 metric ton of agave plant pulp, and then filtering the solution through a press filter having a four micron nominal dimension, to produce the polyfructose solution substantially free of suspended solids. This solution is then heated to 80° C. and heated for 40 minutes, after which the coagulants are removed by filtration through a press filter having a four micron nominal dimension, to produce a partially purified polyfructose solution. The partially purified polyfructose solution is mixed with activated charcoal to form a slurry and agitated at 80° C. for 1 hour. The activated charcoal is removed by filtration of the slurry through a press filter having 4 micron nominally dimensioned pores, to produce a further purified polyfructose extract in which undesirable color, taste, smell and saponin has been removed. The further purified polyfructose extract is then concentrated by evaporation in a vacuum until the extract has a concentration of 30° Brix. The concentrated, further purified polyfructose extract is then passed through an ion exchange column containing Diaion SK 1B and SK 110 cationic resin. After passing the column, the extract reaches a pH of 1.85, and is then heated to 85° during an 8 minute period. The resulting acidified and demineralized polyfructose extract having a pH of 1.85 is then passed through an ion exchange column containing an Diaion PA 308 anionic resin, followed by another pass through the ion exchange column containing cationic resins just described, to produce a demineralized and partially hydrolyzed polyfructose extract. Hydrolysis of this polyfructose extract is achieved by addition of 2880 INU of Novozyme 230 inulin enzyme per liter of polyfructose extract and agitating at 50° C. for 6 hours, at a pH of 4.9, producing a fully hydrolyzed fructose extract thereby. The fructose extract is filtered through a membrane having 0.45 micron nominally dimensioned pores, and concentrated under vacuum evaporation to a concentration of 77.5° Brix, to produce a translucent fructose syrup having a pleasant flavor.

The fructose syrup produced with the method of the present invention has a relatively high fructose content and is substantially free of contaminants such as hydroxymethylfurfural. The aroma and flavor of the agave plant are removed without undue expense, and, alternatively, may be controlled by varying the processing period for some of the purification steps. The concentrated fructose syrup is stable over time and may be used for human consumption in a wide variety of food and beverages.

As can be seen in the description above, the polyfructose extraction process of the present invention requires only a medium capital investment in equipment, and yet provides a high purity fructose syrup with controllable taste, aroma and color, no contaminants, and requires a hydrolysis time of only approximately six hours. In comparison with the known processes set forth above, the inventive extraction process provides several advantages.

A presently preferred embodiment of the present invention and many of its improvements have been described with a degree of particularity. It should be understood that this description has been made by way of preferred example, and that the invention is defined by the scope of the following claims.

What is claimed is:

1. A method of producing a fructose syrup from inulin-containing plant pulp comprising the steps of:

(a) extracting said plant pulp with water to produce a liquefied pulp, wherein said liquefied pulp includes a polyfructose solution;

(b) separating said polyfructose solution from said liquefied plant pulp;

(c) coagulating colloids in said polyfructose solution and removing said coagulated colloids from said polyfructose solution to produce a partially purified polyfructose extract;

(d) contacting said partially purified polyfructose extract with activated charcoal to produce a further purified polyfructose extract;

(e) hydrolyzing said further purified polyfructose extract to produce a hydrolyzed fructose extract by:

(i) reducing the pH of said further purified polyfructose extract by contacting said further purified polyfructose extract with a cation exchange resin to produce a demineralized and partially hydrolyzed polyfructose extract; and (ii) introducing inulin enzymes into said demineralized and partially hydrolyzed polyfructose extract to produce said hydrolyzed fructose extract; and (f) concentrating said hydrolyzed fructose extract to produce a fructose syrup.

2. The method according to claim 1 further comprising the steps of:

concentrating said polyfructose solution and;

removing suspended solids from said polyfructose solution, said concentrating and removing step being accomplished before said coagulating step.

3. The method according to claim 1 wherein said water added in said extraction step is from 60° C. to less than 85° C.

4. The method according to claim 1 wherein said polyfructose solution during said colloid coagulation step is maintained at from 70° to 80° C.

5. The method according to claim 4 wherein said polyfructose solution is maintained at from 70° to 80° C. for approximately 40 minutes.

6. The method according to claim 1 further comprising the steps of:

(a) contacting said further purified polyfructose extract with an anionic exchange resin after said cationic exchange resin contacting step; and (b) further contacting said further purified polyfructose extract with a cationic exchange resin after said anionic exchange resin contacting step.

7. The method of claim 1, wherein said step of reducing pH is less than 30 minutes in duration.

8. The method of claim 1, wherein said step of reducing pH includes lowering the pH to the range between pH 1.8 to 2.3.

9. The method of claim 1, wherein said step of reducing pH does not involve the addition of inorganic acids.

10. The method according to claim 1, wherein said step of contacting said partially purified polyfructose extract with activated charcoal includes the steps of:

(a) agitating said partially purified polyfructose extract and activated charcoal to produce a slurry;

(b) maintaining the temperature of said slurry at from 40° C. to 80° C.;

(c) separating said activated charcoal from said slurry.

11. A method of producing a fructose syrup from inulin-containing plant pulp comprising the steps of:

(a) extracting said plant pulp with water at a temperature of 60° C. to less than 85° C. to produce a liquefied pulp, wherein said liquefied pulp includes a polyfructose solution;

(b) separating and concentrating said polyfructose solution from said liquefied pulp to yield a polyfructose concentrate;

(c) filtering said polyfructose concentrate to remove suspended solids from said polyfructose concentrate;

(d) maintaining and agitating said polyfructose concentrate at from 50° C. to 90° C. for at least 40 minutes to coagulate colloids in said polyfructose concentrate;

(e) removing said coagulated colloids from said polyfructose concentrate to produce a partially purified polyfructose extract;

(f) mixing activated charcoal with said partially purified polyfructose extract to produce a slurry by:

(i) maintaining the temperature of said slurry to from 40° C. to 80° C.;

(ii) agitating said slurry for approximately 30 to 120 minutes;

(iii) removing said activated charcoal from said slurry to produce a further purified polyfructose extract;

(g) hydrolyzing said further purified polyfructose extract to produce a hydrolyzed fructose extract by:

(i) reducing the pH of said further purified polyfructose extract using a cation exchange resin;

(ii) sequentially contacting said further purified polyfructose extract with an anionic exchange resin and a cationic exchange resin to produce a demineralized and partially hydrolyzed polyfructose extract; and (iii) introducing inulin enzymes into said demineralized and partially hydrolyzed polyfructose extract to produce said hydrolyzed fructose extract; and (h) concentrating said hydrolyzed fructose extract to produce a fructose syrup.

12. A method of producing fructose syrup from an inulin-containing plant, comprising the steps of:

(a) converting said inulin-containing plant to a pulp;

(b) extracting said pulp with water to produce a liquefied pulp, wherein said liquefied pulp includes a polyfructose solution;

(c) separating said polyfructose solution from said liquefied pulp;

(d) hydrolyzing said polyfructose solution to produce a hydrolyzed fructose extract by:

(i) reducing the pH of said polyfructose extract using a cation exchange resin to produce a demineralized and partially hydrolyzed polyfructose extract; and (ii) introducing inulin enzymes to said demineralized and partially hydrolyzed polyfructose extract to produce said hydrolyzed polyfructose extract; and (e) concentrating said hydrolyzed fructose extract to produce a fructose syrup.

13. The method according to claim 12, further comprising a coagulation step after said separating step, wherein said coagulation step includes heating said polyfructose solution at between approximately 50° C. and 90° C. to coagulate colloids in said polyfructose fraction and then removing said coagulated colloids.

14. The method according to claim 13, further comprising contacting said polyfructose solution with activated charcoal to remove undesired organic compounds.

15. The method of claim 14, further comprising contacting said polyfructose solution with activated charcoal to remove undesired organic compounds.

16. The method of claim 13, wherein said step of reducing pH is less than 30 minutes in duration.

* * * * *